US011730248B2

(12) United States Patent
Szczepanowski

(10) Patent No.: US 11,730,248 B2
(45) Date of Patent: Aug. 22, 2023

(54) SHAVING RAZOR STAND

(71) Applicant: The Gillette Company LLC, Boston, MA (US)

(72) Inventor: Andrew Anthony Szczepanowski, Noarth Attleboro, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 17/894,282

(22) Filed: Aug. 24, 2022

(65) Prior Publication Data

US 2022/0400828 A1 Dec. 22, 2022

Related U.S. Application Data

(62) Division of application No. 16/818,146, filed on Mar. 13, 2020, now Pat. No. 11,457,715.

(51) Int. Cl.
*A45D 27/29* (2006.01)
*B26B 21/52* (2006.01)

(52) U.S. Cl.
CPC ..... *A45D 27/29* (2013.01); *B26B 21/52* (2013.01)

(58) Field of Classification Search
CPC ..... B26B 19/3833; A45D 27/29; F16B 2001/0035
USPC ..... 248/206.5, 346.11; 30/541; D9/749; D6/526, 534; D4/108; D28/73
See application file for complete search history.

(56) References Cited

U.S. PATENT DOCUMENTS 1,864,874 A * 6/1932 Voight ..... A47K 1/09 248/110
1,981,853 A 11/1934 Bruce
2,027,899 A 1/1936 Bruce
2,781,651 A * 2/1957 Cutler ..... A47G 19/2283 248/346.11
4,224,764 A * 9/1980 Dziewulski et al. .... A01G 9/04 248/346.04
4,473,152 A 9/1984 Jump, Jr.
4,617,768 A * 10/1986 Gebelius ..... E01F 9/615 248/159
5,240,107 A * 8/1993 Casale ..... A45D 27/29 30/40.2
D339,655 S 9/1993 Sulik
5,533,457 A * 7/1996 Cox ..... A47B 13/023 248/188.4
5,584,345 A * 12/1996 Joy ..... A62C 13/78 248/79
5,966,822 A 10/1999 Coffin et al.
6,145,657 A 11/2000 Cox
(Continued)

OTHER PUBLICATIONS

PCT Search Report and Written Opinion for PCT/US2021/021603 dated May 12, 2021, 12 pages.

*Primary Examiner* — Jason Daniel Prone
(74) *Attorney, Agent, or Firm* — John M. Lipchitz

(57) ABSTRACT

A stand for a shaving razor handle with a cover having a top surface defining an opening with a lower cavity in communication with the top surface. The lower cavity having a handle resting surface with a second width configured to support a handle. A base mounted to the cover with a bottom surface opposite the top surface. The bottom surface defining a drainage opening extending into the lower cavity. A ring fixed to the bottom surface. The ring defines a slot extending from an outer edge of the ring to an inner edge of the ring.

6 Claims, 7 Drawing Sheets

(56) References Cited

U.S. PATENT DOCUMENTS

| | | | | |
|---|---|---|---|---|
| 6,202,963 | B1 | 3/2001 | Derman | |
| 6,634,492 | B1 | 10/2003 | Cox | |
| 6,669,153 | B1 | 12/2003 | Allan | |
| D500,221 | S | 12/2004 | Merkel | |
| D513,346 | S | 12/2005 | Buck, Jr. | |
| D519,682 | S | 4/2006 | Choi | |
| D524,730 | S | 7/2006 | Vu | |
| D544,264 | S | 6/2007 | Gallagher | |
| D544,736 | S | 6/2007 | Jackson | |
| D571,505 | S | 6/2008 | Mettler et al. | |
| D572,063 | S | 7/2008 | Provost et al. | |
| D576,436 | S | 9/2008 | Provost | |
| D589,255 | S | 3/2009 | Taylor et al. | |
| D621,637 | S | 8/2010 | Meech et al. | |
| D628,839 | S | 12/2010 | Schulz | |
| 7,866,096 | B2 * | 1/2011 | Lee | E04F 15/02488 248/351 |
| D632,516 | S | 2/2011 | Schulz et al. | |
| D634,955 | S | 3/2011 | Cavazos Jimenez et al. | |
| D655,545 | S | 3/2012 | Bowler | |
| D675,048 | S | 1/2013 | Coresh | |
| D677,090 | S | 3/2013 | Floyd et al. | |
| D677,503 | S | 3/2013 | Floyd et al. | |
| D695,544 | S | 12/2013 | Floyd et al. | |
| D695,545 | S | 12/2013 | Floyd et al. | |
| D699,473 | S | 2/2014 | Szczepanowski et al. | |
| 8,883,075 | B2 | 11/2014 | Henry et al. | |
| D720,154 | S | 12/2014 | Provost et al. | |
| 8,955,228 | B2 | 2/2015 | Eichhorn et al. | |
| D728,963 | S | 5/2015 | Provost et al. | |
| D735,945 | S | 8/2015 | Reishus et al. | |
| D738,133 | S | 9/2015 | Bjerre-Poulsen et al. | |
| D738,134 | S | 9/2015 | Snell | |
| D745,789 | S | 12/2015 | Volk | |
| 9,730,500 | B1 | 8/2017 | Provost et al. | |
| 9,801,502 | B2 | 10/2017 | Ogbuagu | |
| D820,000 | S | 6/2018 | Watson | |
| D831,375 | S | 10/2018 | Ramm et al. | |
| D831,996 | S | 10/2018 | Grabes et al. | |
| 10,104,950 | B1 | 10/2018 | Provost et al. | |
| D839,627 | S | 2/2019 | Watson et al. | |
| D862,923 | S | 10/2019 | Watson | |
| 10,688,674 | B2 | 6/2020 | Schaefer et al. | |
| D904,095 | S * | 12/2020 | Hiller | A47G 19/2283 D6/710 |
| D916,495 | S | 4/2021 | Ramm et al. | |
| 11,457,715 | B2 * | 10/2022 | Szczepanowski | A45D 27/29 |
| D977,868 | S * | 2/2023 | Mesika | A45D 27/29 D6/526 |
| 2006/0145042 | A1 | 7/2006 | Kim | |
| 2008/0052912 | A1 | 3/2008 | Barry et al. | |
| 2008/0209733 | A1 | 9/2008 | Johnson | |
| 2009/0056141 | A1 | 3/2009 | Barry et al. | |
| 2009/0262606 | A1 | 10/2009 | Trost | |
| 2011/0198454 | A1 | 8/2011 | Volk | |
| 2012/0192429 | A1 | 8/2012 | Savarese | |
| 2013/0118937 | A1 | 5/2013 | Gelfand | |
| 2015/0320178 | A1 | 11/2015 | Fish | |
| 2019/0075974 | A1 | 3/2019 | Stewart | |
| 2020/0178669 | A1 | 6/2020 | Johnson et al. | |
| 2021/0282526 | A1 | 9/2021 | Szczepanowski | |
| 2022/0330677 | A1 * | 10/2022 | Peterson | A45D 27/29 |

* cited by examiner

SHAVING RAZOR STAND

This application is a Divisional of U.S. application Ser. No. 16/818,146 filed on Mar. 13, 2020, now U.S. Pat. No. 11,457,715.

FIELD OF THE INVENTION

The present invention relates to personal care system and more particularly to stands for holding shaving razors.

BACKGROUND OF THE INVENTION

Personal care products include dry shaving razors, wet shaving razors, toothbrushes among other types of grooming and hygiene-related implements. An example of a dry shaving razor is an electric razor, which can be used without water, soap, or shaving cream. Wet shaving razors are typically used with water and soap or shaving cream. A wet shaving razor can include a replaceable cartridge in which one or more blades are mounted in a housing. After the blades in a cartridge have become dull from use, the cartridge is discarded, and a new cartridge is replaced on the handle. Personal care products are often stored on a sink, in a medicine cabinet, or on a shelf between uses. Accordingly, personal care products must not only be kept clean and dry between uses, but should also be aesthetically pleasing when displayed on a countertop or sink.

Today consumers have more options than ever before in choosing a shaving razor system. It is typical for consumers to have more than one type of shaving razor handle. Accordingly, each time a consumer decides to purchase a new handle he or she must also replace various accessories they may have had for their previous handle. This can be expensive, especially for higher end accessories, such as shaving razor stands. In addition, a consumer may be less likely to buy an expensive stand if they know they will probably change handles in the future.

Thus, it would be advantageous to provide for a personal care product that addresses one or more of these issues. Indeed, it would be advantageous to provide for a personal care product stand for storing more than one handle type geometry in an aesthetically pleasing manner, thereby allowing a user to leave the personal care product(s) in view between uses while the personal care product(s) dries. It would also be advantageous to provide a stand that is perceived as a premium product in view of its usability, functionality, looks, among other characteristics. Other features and advantages of the invention will be apparent from the following detailed description, and from the claims.

SUMMARY OF THE INVENTION

The present disclosure fulfills the needs described above by, in one embodiment, providing a stand with a top surface defining an opening having an upper cavity and a lower cavity. The upper cavity being in communication with the top surface. The upper cavity having a handle resting surface with a first width configured to support a first shaving razor handle. The lower cavity is positioned below and in communication with the upper cavity. The lower cavity has a handle resting surface with a second width configured to support a second shaving razor handle. The first width is greater than the second width.

In another aspect, the invention features, in general, a first shaving razor having a handle having a first width. A stand having a top surface defining an opening having an upper cavity with a handle resting surface configured to receive the handle of the first shaving razor and a lower cavity having a handle resting surface configured to receive a handle of a second shaving razor. The upper cavity being in communication with the top surface. The lower cavity is positioned below and in communication with the upper cavity. The handle resting surface of the upper cavity has a first width greater than a width of the handle resting surface of the lower cavity.

In another aspect, the invention features, in general a stand for a shaving razor handle having a cover with a top surface defining an opening and a lower cavity in communication with the top surface. The lower cavity has a handle resting surface with a second width configured to support a handle. A base is mounted to the cover and has a bottom surface opposite the top surface. The bottom surface defines a drainage opening extending into the lower cavity. A ring is fixed to the bottom surface. The ring defines a slot extending from an outer edge of the ring to an inner edge of the ring.

BRIEF DESCRIPTION OF THE DRAWINGS

The above-mentioned and other features and advantages of the present disclosure, and the manner of attaining them, will become more apparent, and the disclosure itself will be better understood by reference to the following description of nonlimiting embodiments of the disclosure taken in conjunction with the accompanying drawings, wherein.

DETAILED DESCRIPTION OF THE INVENTION

The present disclosure provides for personal care systems having a handle and a stand for docking the handle when not in use. Various nonlimiting embodiments of the present disclosure will now be described to provide an overall understanding of the principles of the function, design, and operation of the personal care product systems. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment may be combined with the features of other nonlimiting embodiments. Such modifications and variations are intended to be included within the scope of the present disclosure.

Figure 1A:
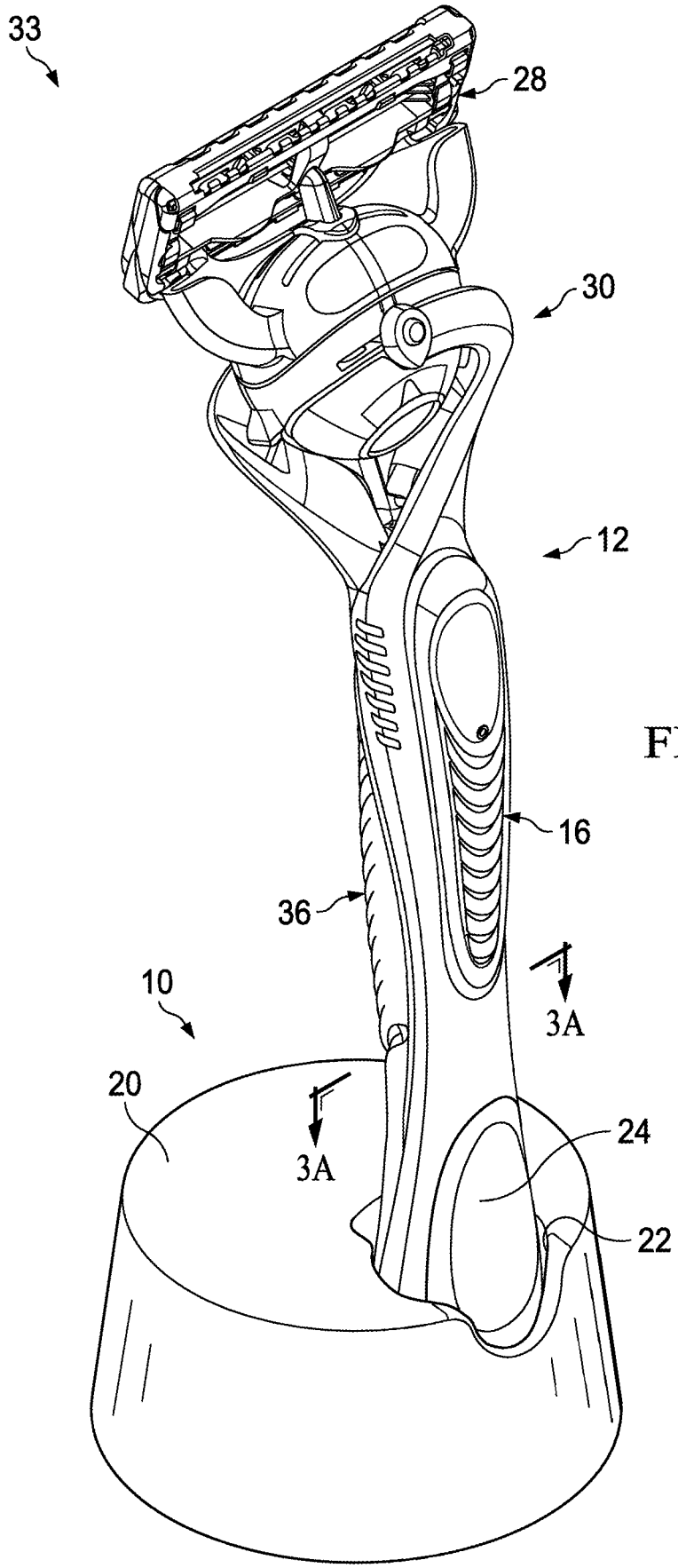
FIG. 1A is a perspective view of a stand for a shaving razor with a first shaving razor handle in accordance with one nonlimiting embodiment of the present disclosure.
Figure 1B:
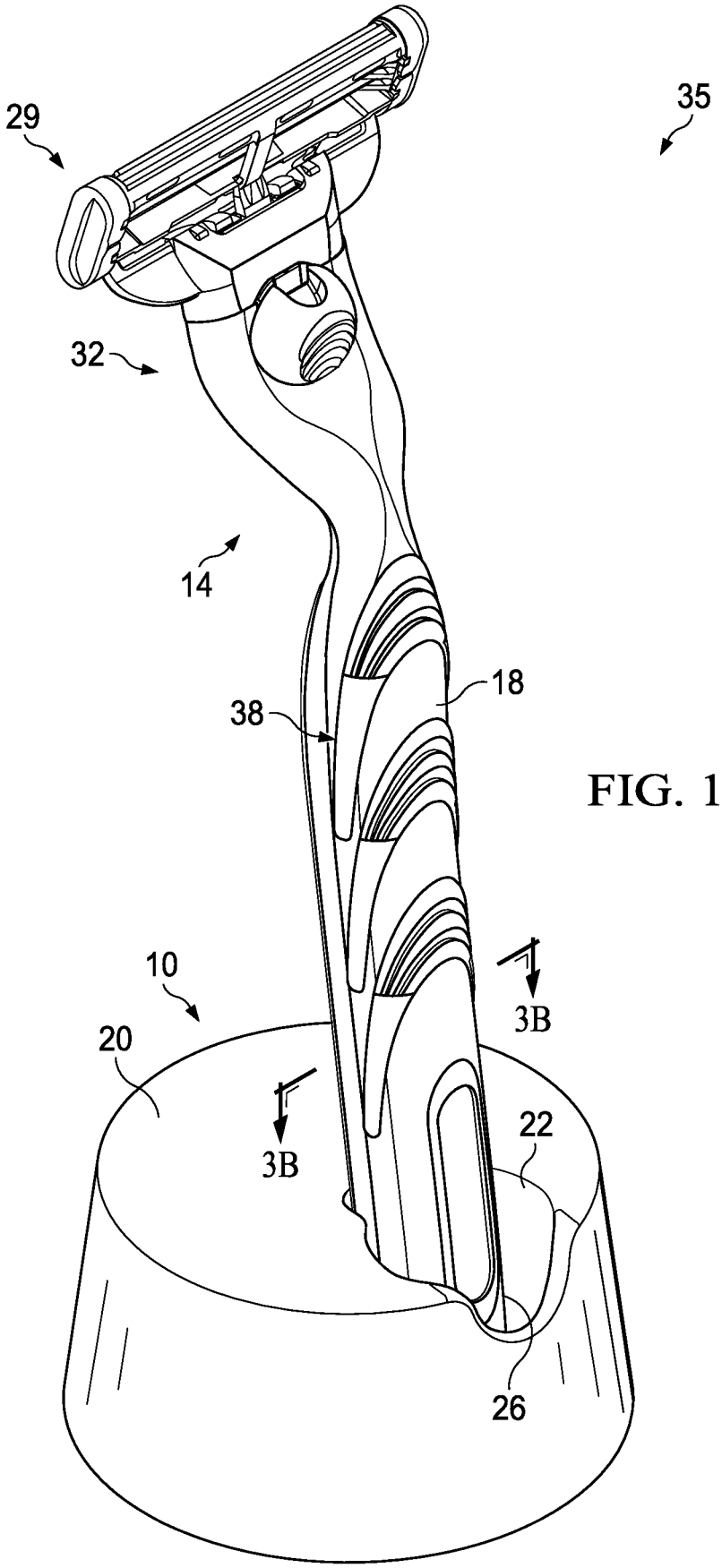
FIG. 1B is a perspective view of the stand for a shaving razor of FIG. 1A with a second shaving razor handle.

Referring now to FIGS. 1A and 1B, perspective views of a stand 10 is depicted in accordance with one nonlimiting embodiment of the present disclosure. The stand 10 may be capable of holding a first shaving razor 12 in a generally upright position, as shown in FIG. 1A. The stand 10 may also be capable of holding a second shaving razor 14 in a generally upright position, as shown in FIG. 1B. The first shaving razor 12 may have a handle 16 that has a different geometry than a handle 18 of the second shaving razor 14. The stand 10 may have a top surface 20 defining an opening 22 configured to receive either the handle 16 of the first shaving razor 12 or the handle 18 of the second shaving razor 14. Accordingly, opening 22 of the stand 10 can accommodate both handles 16 and 18, such that the shaving razors 12 and 14 are maintained in a generally upright position when not in use. The stand 10 provides a much simpler design that allows a consumer to have a single stand to hold different razor handles without the need of additional openings in a top surface of the stand. Dirt, dust, water and shaving debris may become trapped in extra openings that are not being used. As will be described in greater detail below, the handles 16 and 18 are shown in a docked position in FIGS. 1A and 1B. While in the docked position, a first end portion 24 and 26 of the respective handle 16 and 18 can be temporarily secured to the stand 10 (i.e., within the opening 22).

While the handles 16 and 18 are shown as a manual wet shaving razors, such depiction is for illustrative purposes only. Other examples of personal consumer products that can be docked to the stand 10 may include, without limitation, dry razors, epilators or other hair cutting and/or epilating household devices, trimmers, personal groomers, toothbrushes, hair removal devices, and so forth. Further, while shaving razor cartridges 28 and 29 are depicted as being coupled to a respective proximal end 30 and 32 of the handles 16 and 18, in other embodiments the handles 16 and 18 may additionally or alternatively include other types of grooming devices, such as perforated shaving foils, rotary cutters, oscillating cutters, trimmers, and so forth. Accordingly, the handles 16 and 18 with the depicted shaving razor cartridges 28 and 29 is for illustrative purposes only and is not intended to limit the disclosure to any particular configuration of the handles 16 and 18 or the stand 10. In certain embodiments, the stand 10 and one or more of the handles 16 and 18 may be sold together as a kit 33 and 35.

As used herein, the term handle 16 and 18 is to refer to the personal grooming device that can be stored in the stand 10, including any attachable components, such as the respective shaving razor cartridge 28 and 29. While the handles 16 and 18 are shown to have elongated bodies 36 and 38 (respectively) that are generally cylindrical, this disclosure is not so limited. Instead, the elongated bodies 36 and 38 can be any suitable shape, size, or configuration and is the portion of the handle 16 and 18 that is held by the user during use of the shaving razor 12 and 14 (e.g., gripping portion). The shaving razor cartridge 28 and 29 (or other type of attachment or fixed implement) may be fixedly or pivotably mounted to the handles 16 and 18, depending on the overall desired cost and performance. The shaving razor cartridge 28 and 29 may be permanently attached or removably mounted to the respective handle 16 and 18.

Figure 2A:
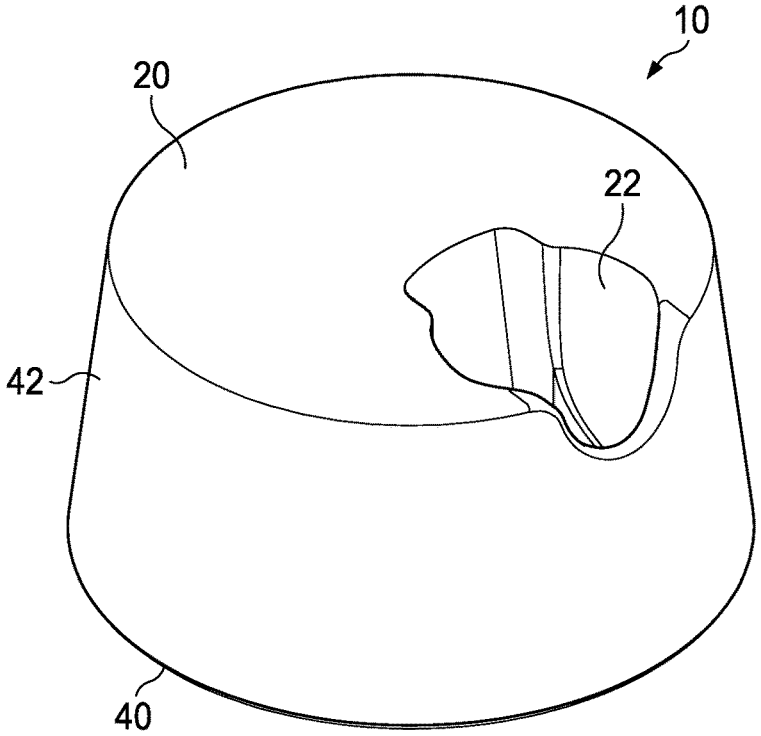
FIG. 2A is a top perspective view of the stand for a shaving razor of FIGS. 1A and 1B.
Figure 2B:
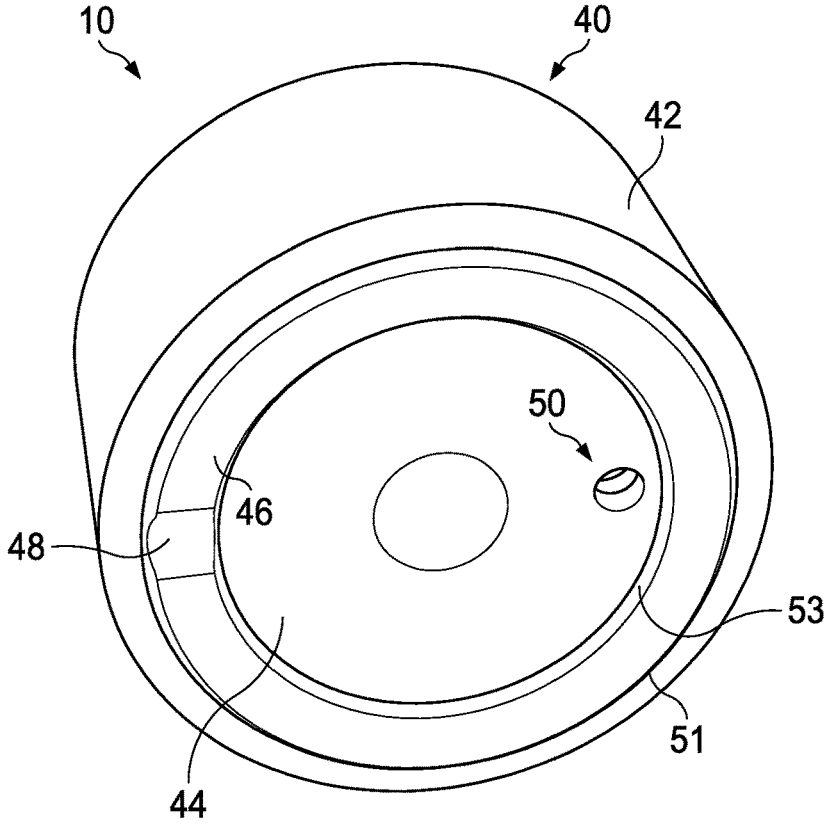
FIG. 2B is a bottom perspective view of the stand for a shaving razor of FIGS. 1A and 1B.

Referring to FIGS. 2A and 2B, a top perspective view and a bottom perspective of the stand 10 are illustrated, respectively. The stand 10 may include a cover 40 having an outer surface 42 that extends to the top surface 20. In certain embodiments, the opening 22 may extend into the top surface 20 and the outer surface 42. The stand 10 may have a bottom surface 44 secured to the cover 40, as shown in FIG. 2B. A ring 46 may be mounted to a portion of the bottom surface 44 to provide stability. For example, the ring 46 may comprise an elastomer, rubber, silicone or other low durometer material to resist the stand 10 sliding on a wet, slippery surface. The ring 46 may define a slot 48 extending from an outer edge 51 to an inner edge 53 of the ring 46. The slot 48 may help prevent water and debris collection by allowing water and or debris to flow under the stand 10. The slot 48 may also act as an air vent under the stand 10 to minimize water entrapment that may cause a suction effect between the bottom surface 44 of the stand and a surface the stand 10 rests on (e.g., a countertop). The bottom surface 44 may define a drainage opening 50 in communication with the opening 22 of the top surface 20. The drainage opening 50 may be positioned within the ring 46 (i.e., the ring 46 surrounds the drainage opening 50). Accordingly, the drainage opening 50 may be spaced apart from a surface the stand 10 rests on (e.g., a countertop) to allow for proper drainage. The opening 50 may be positioned opposite the slot 48 (e.g., 180 degrees). However, it is understood the opening 50 may also be positioned about 160 to about 210 degrees from the slot 48.

Figure 3A:
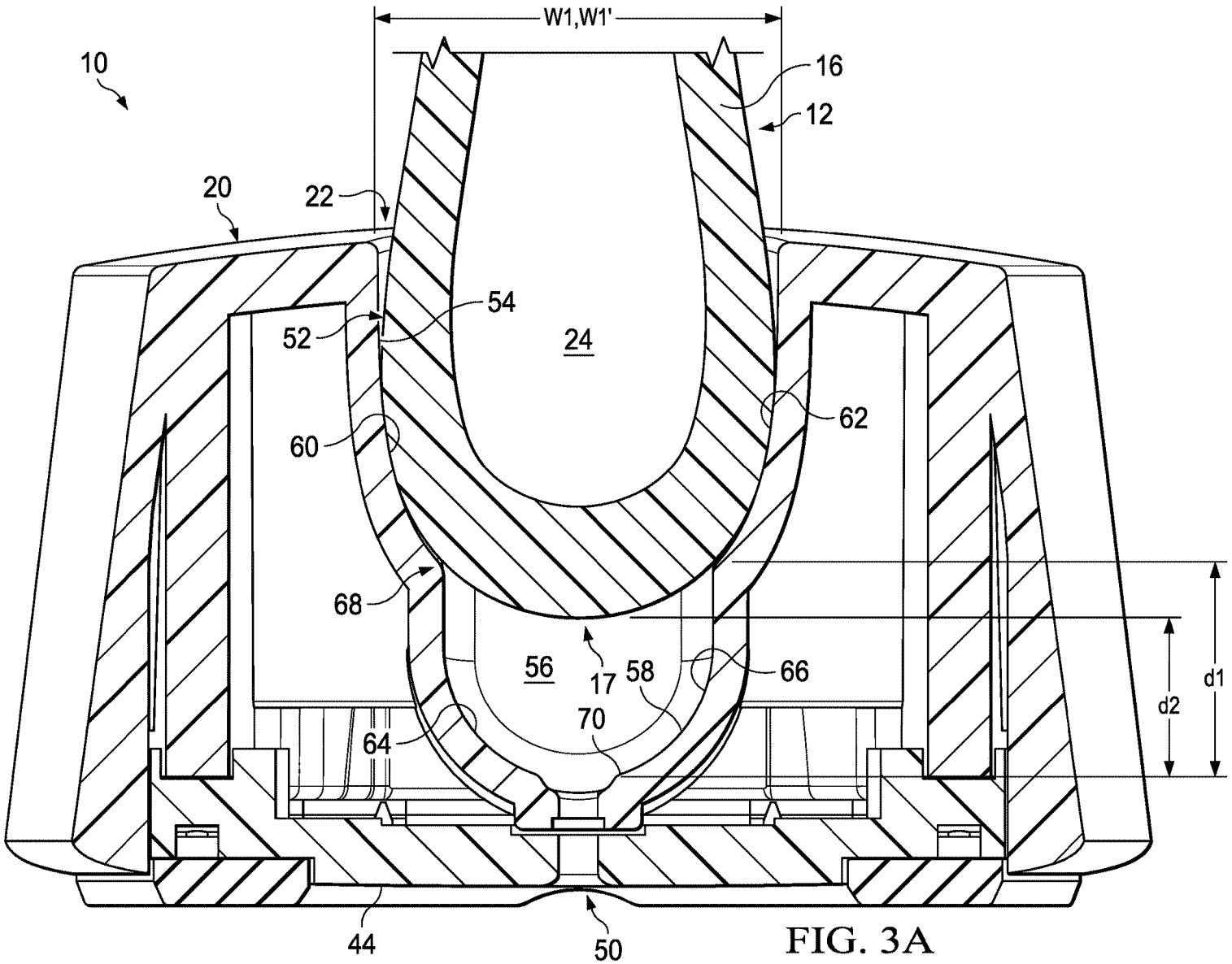
FIG. 3A is a cross sectional view of the stand for a shaving razor, taken generally along the line 3A-3A of FIG. 1A.
Figure 3B:
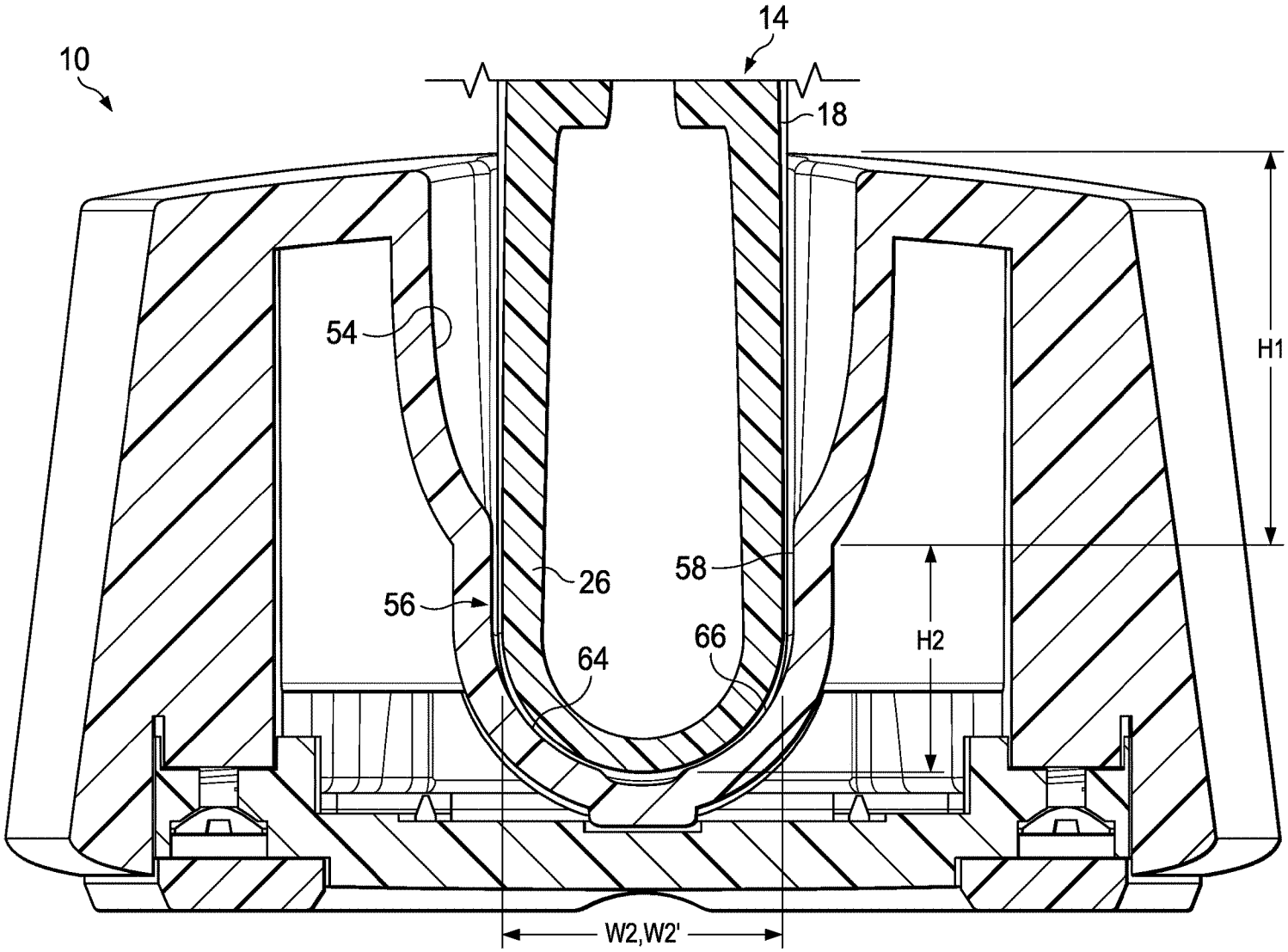
FIG. 3B is a cross sectional view of the stand for a shaving razor, taken generally along the line 3B-3B of FIG. 1B.

Referring to FIGS. 3A and 3B, a cross section view of the stand 10 is illustrated. FIG. 3A is a cross sectional view of the stand 10 with the first shaving razor 12, taken generally along the line 3A-3A of FIG. 1A. FIG. 3B is a cross sectional view of the stand 10 with the second shaving razor 14, taken generally along the line 3B-3B of FIG. 1B. The handle 16 of the first shaving razor 12 may be temporarily mounted within the stand 10 with the first end portion 24 of the handle 16 positioned within the opening 22 of the top surface 20, as illustrated in FIG. 3A. The opening 22 may extend into the stand 10 (e.g., cover 40) forming an upper cavity 52 configured to receive the handle 16 of the first shaving razor 12. The upper cavity 52 may be dimensioned to receive the first distal end portion 24. For example, the upper cavity 52 may have a handle resting surface 54 configured to support the first distal end portion 24. The handle resting surface 54 of the upper cavity 52 may have a first width W1 configured to engage the handle 16 of the first shaving razor 12. The handle 16 of the first shaving razor 12 may have a width W1' that corresponds with the first width W1 of the upper cavity 52. For example, W1' may be slightly less than the W1 to allow for easy insertion and removal of the handle 16, yet still securely hold the handle 16 when it is not in use.

A lower cavity 56 may be positioned below and extend into the upper cavity 52. The lower cavity 56 may be positioned below and in communication with the upper cavity 52. The lower cavity 56 may have a handle resting surface 58 with a second width "W2" configured to support the handle 18 of the second shaving razor 14, as shown in FIG. 3B. The lower cavity 56 may be dimensioned to engage the first distal end portion 26 of the handle 18. The handle 18 (e.g., the distal end portion 26) of the second shaving razor 14 may have a width W2' that corresponds with the second width W2 of the lower cavity 56 (FIG. 3B). For example, W2' may be slightly less than the W2 to allow for easy insertion and removal of the handle 18, yet still securely hold the handle 18 when it is not in use. The second width W2 may be less than the first width W1 to properly engage and hold the second shaving razor handle 18. The width W2 of the second shaving razor 14 (i.e., distal end portion 26) may be less than the first width W1 such that the distal end portion 26 passes through the upper cavity 54 and is properly seated within the lower cavity 56. In certain embodiments, the handle resting surface 58 of the lower cavity 56 may be spaced apart from the handle resting surface 54 of the upper cavity 52 by a distance "d1" of about 5.4 mm to about 9.4 mm. Accordingly, when the first shaving razor handle 16 is place within the upper cavity 52, the first shaving razor handle 16 may be spaced apart from the handle resting surface 58 of the lower cavity 56, which may allow for improved drainage of water. In certain embodiments, the first shaving razor handle 16 may extend into the lower cavity 56 but may not engage the handle resting surface 58 of the lower cavity 56. The first shaving razor handle 16 may be positioned in an engaged positioned within the upper cavity 52 such that a distal end 17 of the first shaving razor handle 16 is spaced apart from the resting surface 58 of the lower cavity 56 by a distance "d2" of about 3.1 mm to about 7.1 mm.

The upper cavity 52 may be partially defined by a pair of opposing side walls 60 and 62.

The distance W1 may be measured as the greatest distance between the opposing side walls 60 and 62 that engage the shaving razor handle 16. Similarly, the lower cavity 56 may be partially defined by a pair of opposing side walls 64 and 66. The distance W2 may be measured as the greatest distance between the opposing side walls 64 and 66 that engage the shaving razor handle 18. The handle resting surface 58 of the lower cavity 56 and the handle resting surface 54 of the upper cavity 52 may have a respective lower surfaces 68 and 70. The lower surface 68 may be the lower most point that contacts the shaving razor handle 16. The lower surface 70 may be the lower most point that contacts the shaving razor handle 18. Accordingly, the distance d1 may be measured as the vertical distance between the lower surface 68 and the lower surface 70. The drainage opening 50 defined by the bottom surface 44 may extend through the lower surface 70 and into the lower cavity 56. In certain embodiments, one or more of the opposing side walls 60 and 62 of the upper cavity 52 may have a radius that is greater than a radius of at least one of the opposing side walls 66 and 68 of the lower cavity 56. As shown in FIG. 3B, the upper cavity 52 may have a height "H1" extending from the lower surface 68 to the top surface 20. The lower cavity 56 may have a height "H2" extending from the lower surface 68 to the lower surface 70. The height H1 may be greater than the height H2 to provide a more balanced stand 10, which is more resistant to tipping. It is understood that the stand 10 may hold more than two different razor geometries by providing additional handle resting surfaces that are separate from the handle resting surfaces of the first handle and the second handle.

Figure 4:
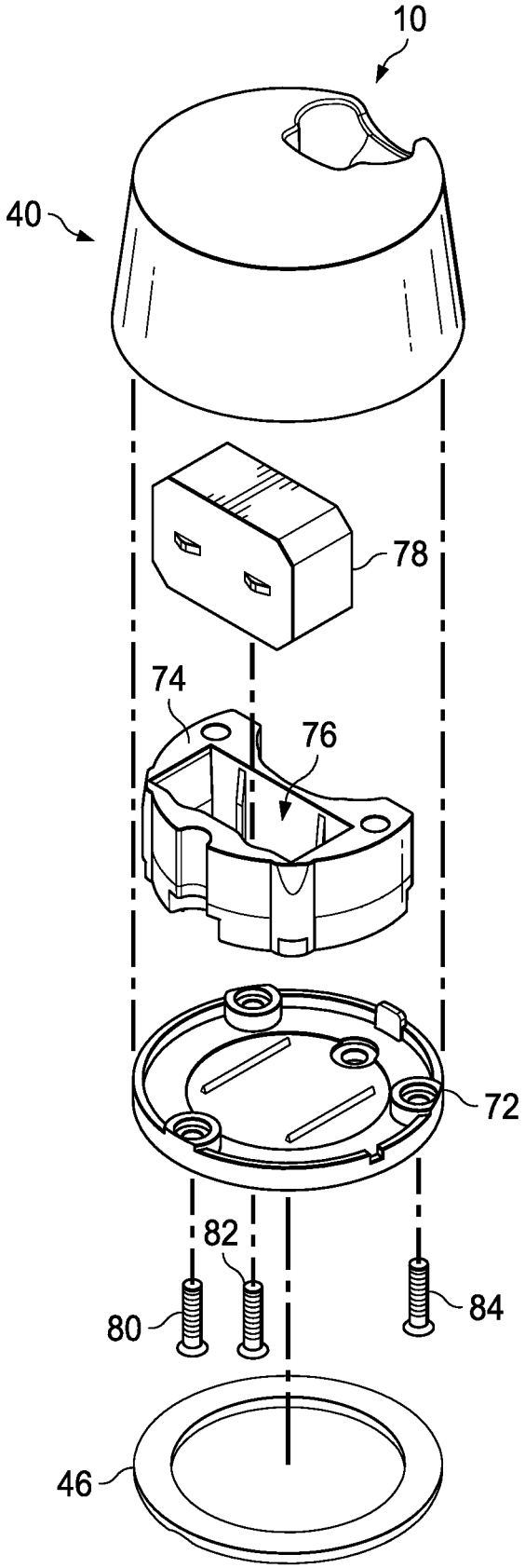
FIG. 4 is first exploded assembly view of the stand for a shaving razor.
Figure 5:
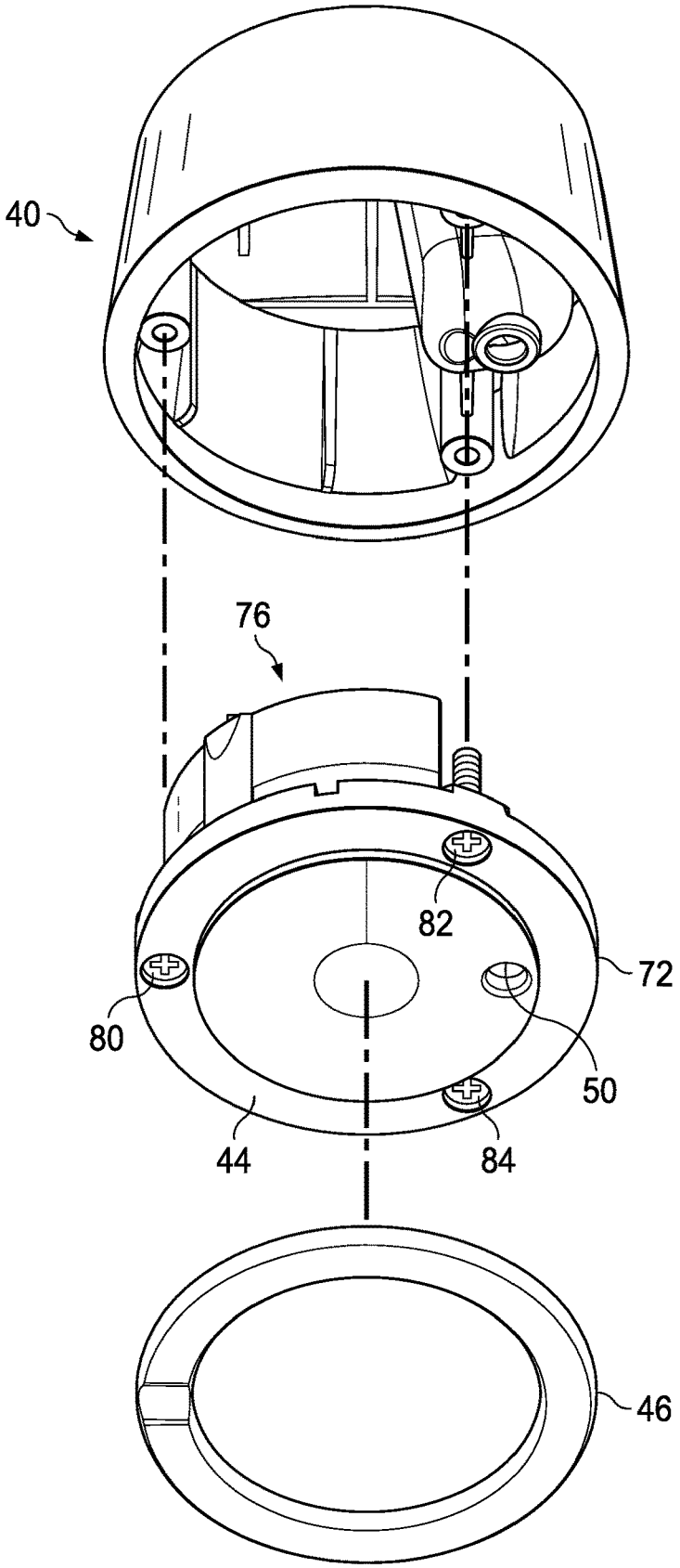
FIG. 5 is second exploded assembly view of the stand for a shaving razor.

Referring to FIGS. 4 and 5 exploded assembly views of the stand 10 are illustrated. The stand 10 may include a base 72. The base 72 may include the bottom surface 44 of the stand 10, as shown in FIG. 5. A body 74 may be mounted to the base 72. The body 74 may define a pocket 76 dimensioned to receive a weight 78. The weight 78 may comprise heavy materials such as steel, iron, zinc, nickel or combinations thereof. For example, the weight 78 may comprise over 25% of the overall weight of the stand 10 (e.g., about 25% to about 50%). The cover 40 may be mounted to the body 74 (e.g., on top of the body 74) and secured to the base 72 with one or more fasteners 80, 82 and 84. The ring 46 may then be mounted to the bottom surface 44 and cover the one or more fasteners 80, 82 and 84.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A stand for a shaving razor handle comprising:

a cover having a top surface defining an opening with a lower cavity in communication with the top surface, the lower cavity defined by a handle resting surface with a width configured to support a handle;

a base mounted to the cover with a bottom surface opposite the top surface, the bottom surface defining a drainage opening extending into the lower cavity;

a ring fixed to the bottom surface, wherein the ring defines a slot extending from an outer edge of the ring to an inner edge of the ring.

2. The stand of claim 1 wherein the ring is spaced apart from the drainage opening.

3. The stand of claim 1 wherein the drainage opening is positioned about 160 to about 210 degrees from the slot.

4. The stand of claim 1 wherein the ring surrounds the drainage opening.

5. The stand of claim 1 further comprising a plurality of fasteners extending into the bottom surface securing the base to the cover, wherein the ring is mounted over the fasteners.

6. The stand of claim 1 further comprising a body defining a pocket configured to receive a weight, wherein the body is mounted to the base and the cover is positioned over the body.

* * * * *